US007053843B2

(12) United States Patent
Nysen

(10) Patent No.: US 7,053,843 B2
(45) Date of Patent: May 30, 2006

(54) MULTI-BAND ANTENNA SYSTEM

(75) Inventor: Paul A. Nysen, Sunnyvale, CA (US)

(73) Assignee: Sierra Wireless, Inc., Richmond (CA)

( * ) Notice: Subject to any disclaimer, the term of this patent is extended or adjusted under 35 U.S.C. 154(b) by 0 days.

(21) Appl. No.: 10/761,621

(22) Filed: Jan. 20, 2004

(65) Prior Publication Data

US 2005/0156796 A1 Jul. 21, 2005

(51) Int. Cl.
*H01Q 1/24* (2006.01)

(52) U.S. Cl. ..... 343/702; 343/795; 343/846

(58) Field of Classification Search ..... 343/795, 343/725, 700 MS, 820–823, 702, 846; 455/67.11, 455/67, 15

See application file for complete search history.

(56) References Cited

U.S. PATENT DOCUMENTS

| | | | | |
|---|---|---|---|---|
| 5,867,131 | A * | 2/1999 | Camp et al. | 343/797 |
| 6,160,514 | A * | 12/2000 | Judd | 343/700 MS |
| 6,369,771 | B1 * | 4/2002 | Chiang et al. | 343/795 |
| 6,417,806 | B1 * | 7/2002 | Gothard et al. | 343/700 MS |
| 6,448,930 | B1 * | 9/2002 | Judd | 343/700 MS |
| 6,531,985 | B1 * | 3/2003 | Jones et al. | 343/702 |
| 2003/0020656 | A1 | 1/2003 | Shor | |
| 2003/0210199 | A1 | 11/2003 | Douglas et al. | |
| 2003/0232600 | A1 * | 12/2003 | Montgomery et al. | 455/67.11 |
| 2004/0056812 | A1 * | 3/2004 | Sabet et al. | 343/725 |
| 2004/0110469 | A1 * | 6/2004 | Judd | 455/15 |

FOREIGN PATENT DOCUMENTS

| | | |
|---|---|---|
| WO | 99/21245 | 4/1999 |

* cited by examiner

*Primary Examiner*—Tan Ho
*Assistant Examiner*—Hung Tran Vy
(74) *Attorney, Agent, or Firm*—Thelen Reid & Priest LLP

(57) ABSTRACT

A multi-band antenna system for a portable communications device (e.g. a PC Card wireless modem) is disclosed. The multi-band antenna system comprises a dipole antenna, a reactive circuit, and transmission means coupled between the reactive circuit and the dipole antenna. For signals having frequencies within a first frequency band (e.g. the CDMA 0.86 GHz band), the reactive circuit operates as a trap, i.e. as a substantially high impedance, which enables a radiation impedance of a monopole formed by the presence of the trap to be coupled directly into the feed system (e.g. a diplexer) of the antenna system. The dipole antenna is configured and dimensioned to receive signals within a second frequency band (e.g. the PCS 1.92 GHz band). Second frequency band signals received by the dipole antenna are conducted through the signal conductor of the transmission means to the feed system substantially unimpeded by the reactive circuit. The multi-band antenna system may further include a diversity antenna, which may be configured so that it is polarized orthogonal the to dipole antenna.

13 Claims, 7 Drawing Sheets

MULTI-BAND ANTENNA SYSTEM

FIELD OF THE INVENTION

The present invention relates to antennas for receiving radio frequency (RF) signals. More particularly, the present invention relates to multi-band antenna systems capable of receiving signals from different frequency bands and/or signals from wireless networks defined by competing wireless network technologies.

BACKGROUND OF THE INVENTION

The development, deployment and refinement of wireless communication systems and devices have increased dramatically over recent years. Indeed, the cellular telephone, which was an expensive and awkward device to use just a couple of decades ago, has become commonplace in today's world. Communicating wirelessly is desirable since it allows user mobility and provides a user, in most respects, the ability to establish communications with another user irrespective of knowledge of the other user's location.

The prospect that the mobile nature of wireless communications would extend from just voice communications to data communications was inevitable. Indeed, wireless data communications between portable computers and other portable devices (e.g. laptop computers and personal digital assistants (PDAs)) has become one of the fastest growing technology areas.

A number of approaches have been proposed and developed to support the demand for wireless data communications. A popular one of these approaches involves the use of a PC Card wireless modem (also referred to as a wireless "network interface card" or wireless "NIC"), which functions as an interface between a portable data communications device (e.g. a laptop computer or PDA) and a wireless wide area network (e.g. a cellular wireless network). A PC Card is a peripheral device, which conforms to standards (e.g. electrical specifications and form factor requirements) set by the PCMCIA (Personal Computer Memory Card International Association). Although originally formed to formulate standards relating to adding memory to portable computers, the PCMCIA standard has been expanded several times and is now applicable to many types of devices, including PC card wireless modems.

A PC Card wireless modem is about the size of a credit card and plugs into a PCMCIA slot of a portable communications device. FIG. 1 shows a conceptual diagram of a laptop computer 10 with a PC Card wireless modem 12 plugged into a PCMCIA slot 14 of the laptop computer 10. Similar to a cellular telephone, the PC Card wireless modem 12 includes an antenna 16 for receiving radio frequency RF signals from a remote device over a wide area network. The dimensions of the antenna 16 are set so that the antenna 16 can properly receive RF signals within a frequency band, e.g. as may be defined by a particular wireless technology standard. For example, as shown in FIG. 2, the antenna 16 may be dimensioned so that it is capable of receiving PCS band (1.92 GHz) frequencies. While this is beneficial, the fixed dimensions of the antenna 16 limit the PC Card wireless modem's reception capabilities to only PCS band signals. In other words, the fixed dimensions of the antenna restrict the use of the PC Card wireless modem to a single wireless technology. FIG. 2 illustrates this limitation imposed on a PC Card wireless modem having an antenna 16 configured to receive 1.92 GHz PCS band signals. While the antenna 16 is capable of receiving signals from within the 1.92 GHz PCS band, its dimensions are too small to properly receive CDMA 0.86 GHz band (i.e. CDMA800) signals.

It would be desirable, therefore, to have an antenna system for a PC Card wireless modem, or equivalent device, capable of properly receiving RF signals from more than a single frequency band and/or capable of receiving RF signals from wireless networks defined by competing wireless technologies.

SUMMARY OF THE INVENTION

A multi-band antenna system for a portable communications device (e.g. a PC Card wireless modem) is disclosed. The multi-band antenna system comprises a dipole antenna, a reactive (e.g. an LC) circuit, and transmission means coupled between the reactive circuit and the dipole antenna. According to an aspect of the invention, the reactive circuit is formed by the combination of a short piece of transmission line of the transmission means and a shunt capacitor. The transmission means, including the short piece of transmission line may comprise coaxial cable, microstrip, stripline, or combination thereof. The ground conductor of the short piece of transmission line is configured and dimensioned to provide an inductive element (i.e. a shunt inductor) for the reactive circuit. For signals having frequencies within a first frequency band (e.g. the CDMA 0.86 GHz band), the reactive circuit operates as a trap, i.e. as a substantially high impedance, which enables a radiation impedance of a monopole formed by the presence of the trap to be coupled directly into a feed system (e.g. a diplexer) of the antenna system. The combination of one pole of the dipole antenna and the ground conductor of a portion of the transmission means form the monopole (or "whip antenna"), which has a length suitable for receiving signals within the first frequency band. The dipole antenna receives signals within a second frequency band (e.g. the PCS 1.92 GHz band) and conducts these signals through the signal conductor of the transmission means to the feed system substantially unimpeded by the reactive circuit.

The multi-band antenna systems disclosed herein are linear, reciprocal and bidirectional. Accordingly, the multi-band antenna systems of the present invention are capable of transmitting signals having frequencies in the first and second frequency bands just as well as they are capable of receiving such signals. For ease in description, however, the following detailed description is presented only in the context of received signals. Nevertheless, those of ordinary skill in the art will readily appreciate and understand that through reciprocity the following description, including the claims, is also applicable to signals transmitted by the multi-band antenna systems.

Other aspects of the invention are described and claimed below, and a further understanding of the nature and advantages of the invention may be realized by reference to the remaining portions of the specification and the attached drawings.

DETAILED DESCRIPTION

Embodiments of the present invention relate to multi-band antenna systems capable of receiving signals from different frequency bands and/or signals from wireless networks defined by competing wireless network technologies. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or similar parts.

Figure 1:
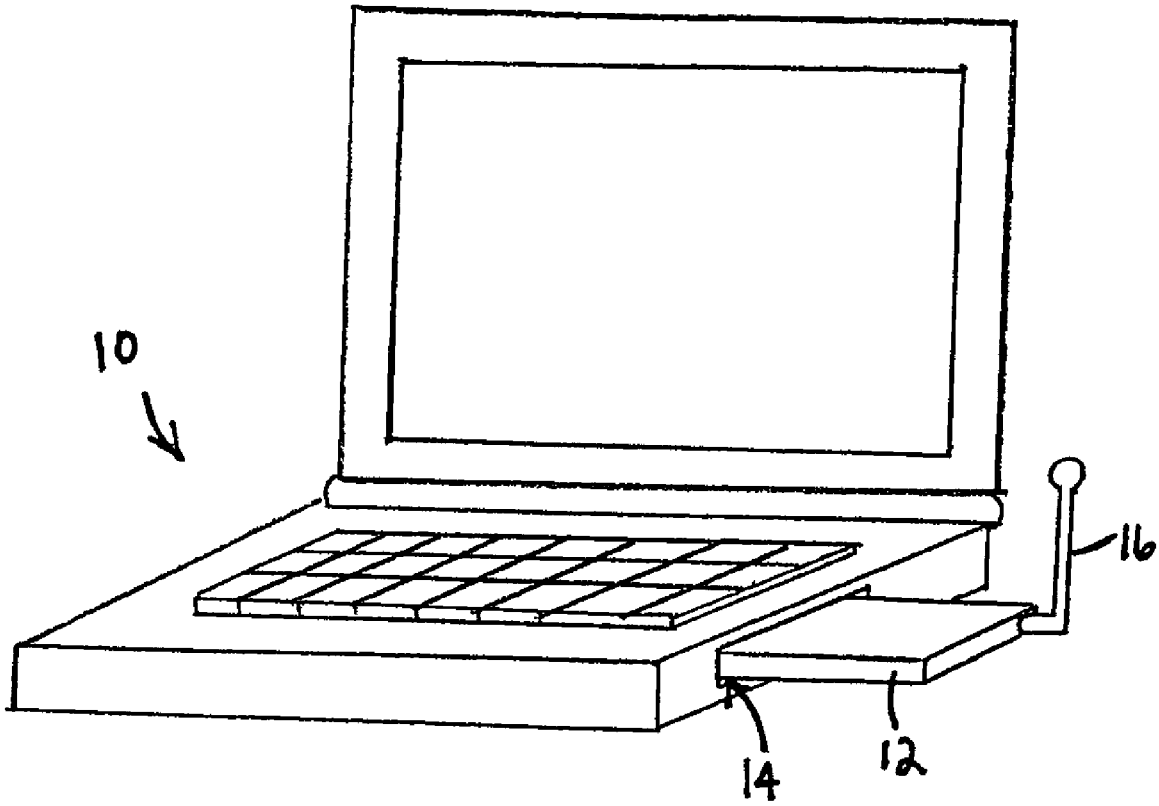
FIGURE 1 (PRIOR ART)
FIG. 1 shows a conceptual diagram of a laptop computer with a PC Card wireless modem plugged into a PCMCIA slot of the laptop computer.
Figure 2:
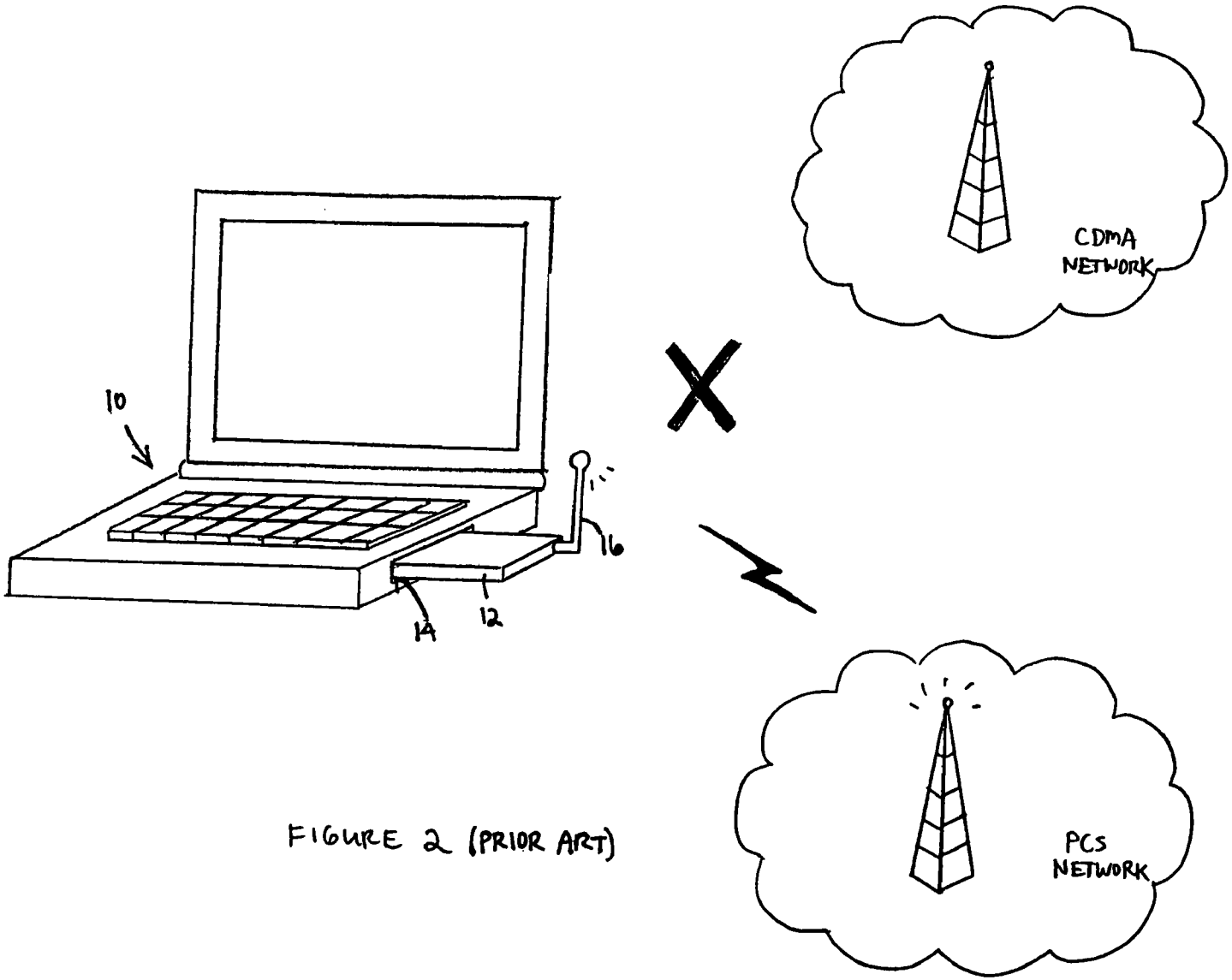
FIGURE 2 (PRIOR ART)
FIG. 2 illustrates how a prior art antenna of a PC Card wireless modem is capable of receiving RF signals having frequencies within a band of operation of a first wireless network technology (e.g. 1.92 GHz PCS band) but is incapable of receiving RF signals having frequencies within a band of operation of a second wireless network technology (e.g. 0.86 GHz CDMA band)
Figure 3:
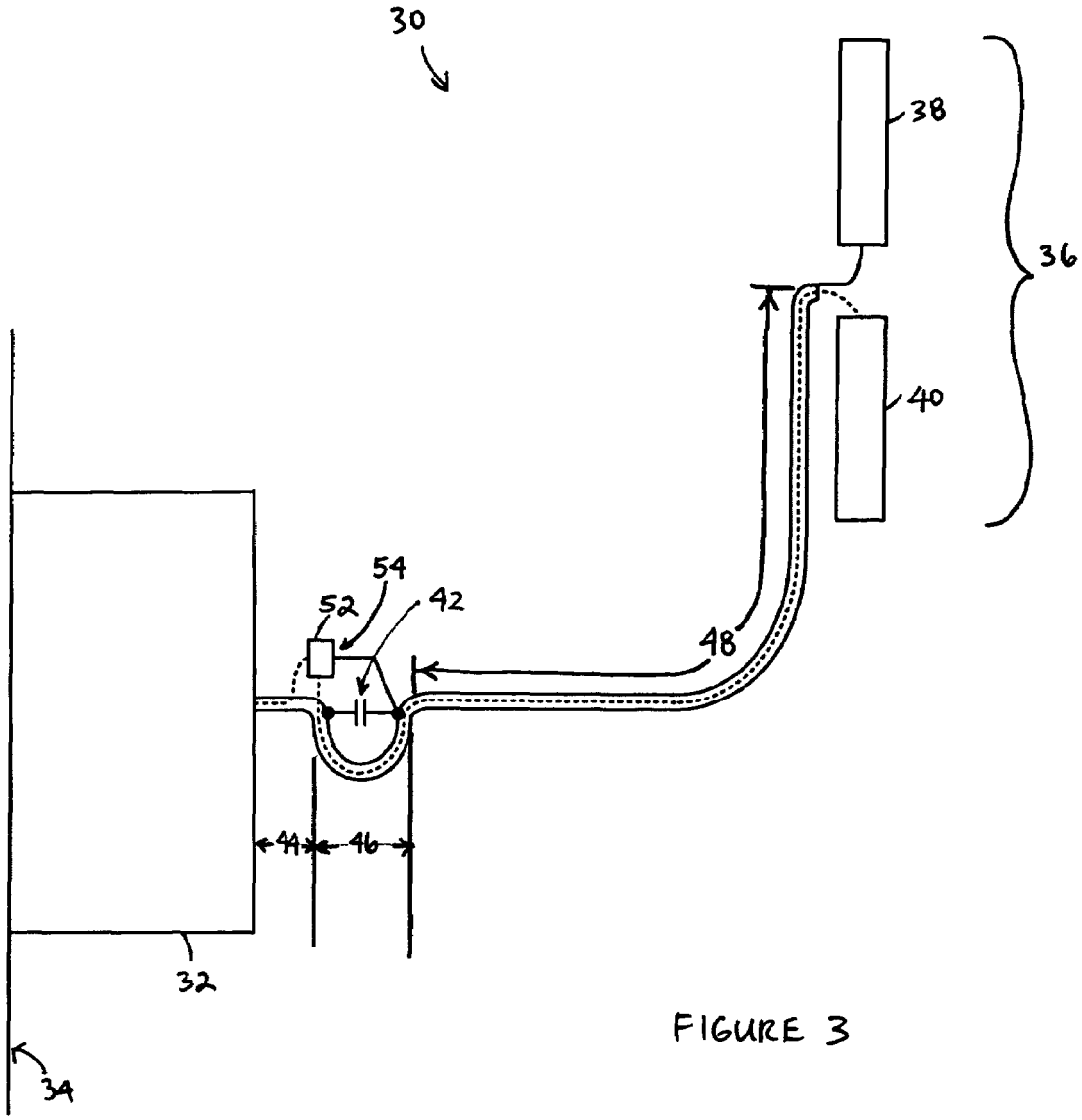
FIG. 3 shows a multi-band antenna system according to an embodiment of the present invention.

FIG. 3 shows a multi-band antenna system 30, according to an embodiment of the present invention. The multi-band antenna system 30, as well as the other multi-band antenna system embodiments described herein, are designed so that they may be plugged into a PC Card wireless modem 32 or other communications device. The PC Card wireless modem 32, in turn, is plugged into a PCMCIA slot of a portable computer 34 (e.g. laptop, PDA, etc.) and functions as a wireless network interface for communicating with a remote device over a wireless network. The multi-band antenna system 30 comprises a dipole 36 having a first pole 38 and a second pole 40, a coaxial cable, and a shunt capacitor 42.

The coaxial cable of the multi-band antenna 30 comprises three sections: a PC Card feed section 44, a loop section 46 and an extension section 48. The coaxial cable may be rigid or flexible. The flexible coaxial cable option is advantageous in that it allows a user to manipulate the antenna system 30 for optimum reception of RF signals. The outer conductor (i.e. ground conductor) of the coaxial cable at a first end of the PC Card feed section 44 is coupled to a ground plane of the PC Card wireless modem 32, which may comprise, for example, the housing of the PC Card wireless modem if it is conductive and/or the ground plane of the main printed circuit board of the PC Card wireless modem 32. In this manner the ground plane, including the housing if it is used, functions as a counterpoise for the multi-band antenna system 30. The inner conductor (i.e. signal conductor) at the first end of the feed section 44 is configured for coupling to the front end electronics of an RF receiver in the PC Card wireless modem 32. The outer conductor of the coaxial cable at a first end of the extension section 48 is coupled to the first pole 38 of the dipole 36, and the inner conductor of the coaxial cable at the first end of the extension section 48 is coupled to the second pole 40 of the dipole 36.

The outer conductor at a first end of the loop section 46 is coupled to the outer conductor of the second end of the PC Card feed section 44, and the outer conductor of a second end of the loop section 46 is coupled to the outer conductor of a second end of the extension section 48. First and second terminals of a shunt capacitor 42 are coupled to the outer conductor at the first end and at the second end of the loop section 46, respectively. Together the outer conductor of the loop section 46 and the shunt capacitor 42 form a reactive circuit, which operates as a trap for received signals having frequencies within a first frequency band (e.g. CDMA 0.86 GHz band).

According to an embodiment of the invention, the multi-band antenna system 30 in FIG. 3 is designed so that it can receive both RF signals having frequencies within a first frequency band of interest and RF signals having frequencies within a second frequency band of interest. An inductive element (i.e. a shunt inductor) formed from the outer conductor of the loop section 46 and the shunt capacitor 42 comprise a reactive circuit. The shape and dimension of the outer conductor of the loop section 46 are made so that the shunt inductor has a predetermined inductance. This inductance of the shunt inductor and a capacitance of the shunt capacitor 42 are predetermined so that the reactive circuit operates as a trap (i.e. presents itself as a substantially high impedance) for received signals having frequencies within the first frequency band. For example, for RF signals having frequencies within the CDMA 0.86 GHz band, the loop section 46 may be formed so that it has an inductance of 4 nH and the capacitance of the shunt capacitor 42 is selected so that it has a value of 8 pF.

As alluded to above, the reactive circuit is designed and configured so that it operates as a trap for received signals having frequencies within a first frequency band. Under these conditions, the combined lengths of the first pole 38 of the dipole 36 and the outer conductor of the extension section 48 of the coaxial cable form a monopole antenna (i.e. a "whip antenna"), the combined length which is suitable for receiving signals from within the first frequency band. For example, if the first frequency band corresponds to the CDMA 0.86 GHz band, the combined lengths can be made so that it is approximately 80 mm. For an 80 mm combined length, the first pole 38 can be made to be approximately 20 mm and the length of the extension section 48 can be made to be approximately 60 mm.

Taking advantage of the presence of the trap, the monopole antenna is fed directly into the feed system of the antenna system. According to an aspect of the invention the feed system comprises a diplexer 52, which as shown in FIG. 3 is configured to receive the radiation impedance of the monopole antenna at a first input 54 and transmit it to the front end electronics of the RF receiver of the PC Card wireless modem 32. Whereas a diplexer is shown, those of ordinary skill in the art will readily understand that other feed system apparatuses may be used. For example, a split-off and separate transmission means (e.g. a coaxial cable section separate from the primary transmission means) may be used to receive the radiation impedance of the monopole antenna and conduct it to the front end electronics of the RF receiver.

For signals having frequencies outside the first frequency band of interest and within the second frequency band of interest (for example, as might be the PCS 1.92 GHz band), the reactive circuit does not operate as a trap, and signals are received by the dipole 36 and transmitted to a second input of the feed system (e.g. comprising diplexer 52) via the signal conductors of the extension section 48, the loop section 46, the diplexer 52 (or other equivalent feed system), and the PC Card feed section 44. The dipole 36 is dimensioned so that it is capable of receiving signals within the second frequency band. According to an aspect of the invention, if the second frequency band corresponds to the PCS 1.92 GHz band, the lengths of the first and second poles 38 and 41 of the dipole 36 are approximately 20 mm each, so that their combined length forms a quarter wavelength dipole. Those of ordinary skill in the art will readily understand that the dipole length may have other dimensions (e.g. half, or other fractional wavelength) depending on the design objectives and constraints at hand.

Figure 4:
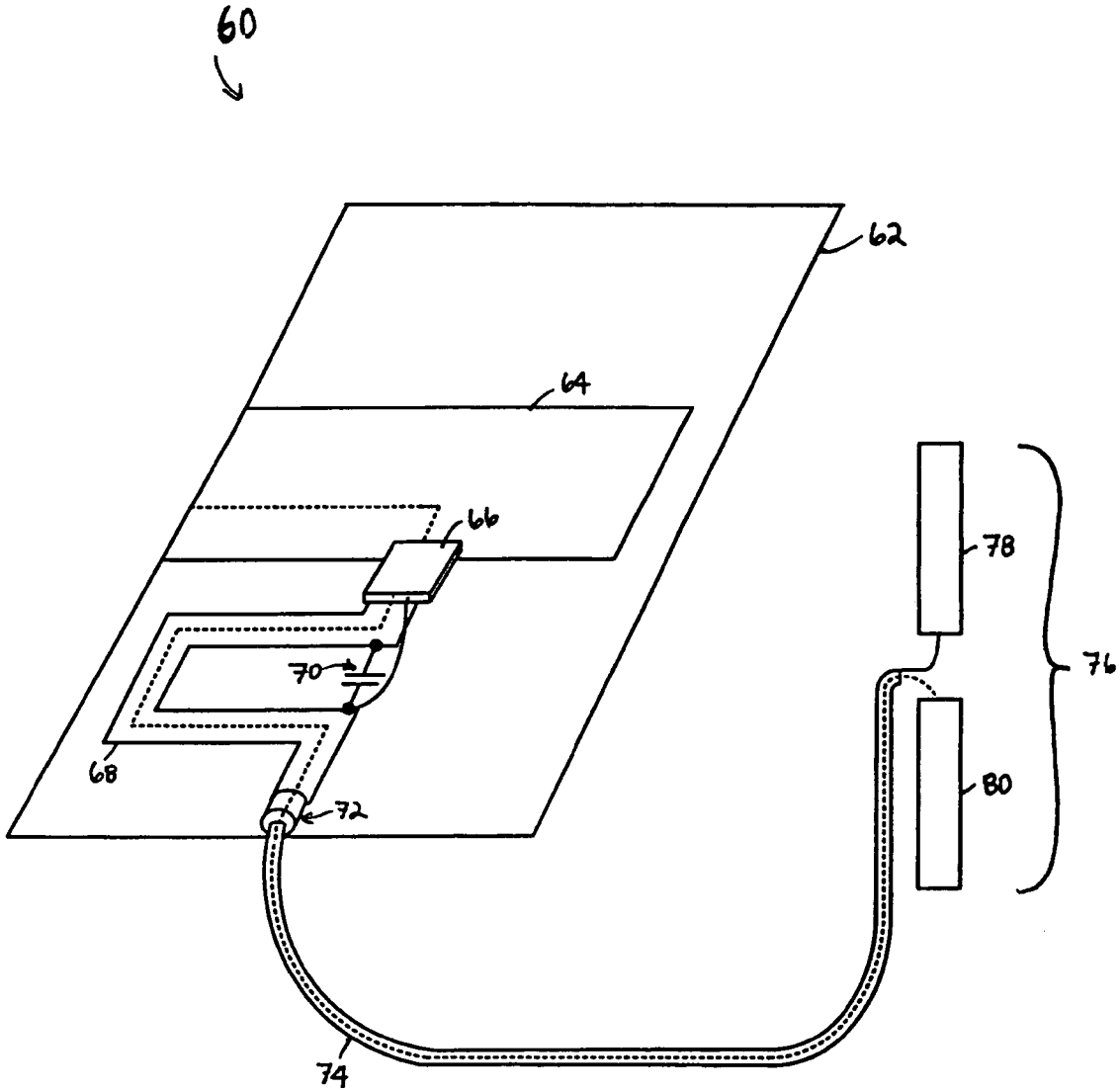
FIG. 4 shows a multi-band antenna system wherein a portion of the antenna system is formed on a printed circuit board, according to an embodiment of the present invention.

Referring to FIG. 4, there is shown a multi-band antenna system 60 according to another embodiment of the present invention. This embodiment is similar to that shown in FIG. 3, except that loop section 46 and PC Card feed section 44 are formed using stripline (alternatively microstrip) on a first printed circuit board (PCB) 62. The first PCB 62, which, according to one aspect of the invention, is housed within the housing of the PC Card wireless modem 32, includes a ground plane 64 upon which a feed system (which may comprise, for example, a diplexer 66) is coupled, a loop section 68, and a shunt capacitor 70. The loop section 68 includes a signal conductor and a ground conductor, which, similar to the outer conductor of the loop section 46 of the coaxial cable in the embodiment shown in FIG. 3, forms an inductive element (i.e. shunt inductor). The shunt capacitor 70 is coupled in parallel with the shunt inductor to form a reactive circuit. A coaxial cable connector 72 is configured to receive a first end of a coaxial cable 74. At a second end of the coaxial cable 74, an outer conductor couples to a first pole 78 of a dipole 76, and an inner conductor coupled to a second pole 80 of the dipole 76. Operation of the multi-band antenna system 60 is substantially similar to the operation of the multi-band antenna system 30 described above.

Figure 5:
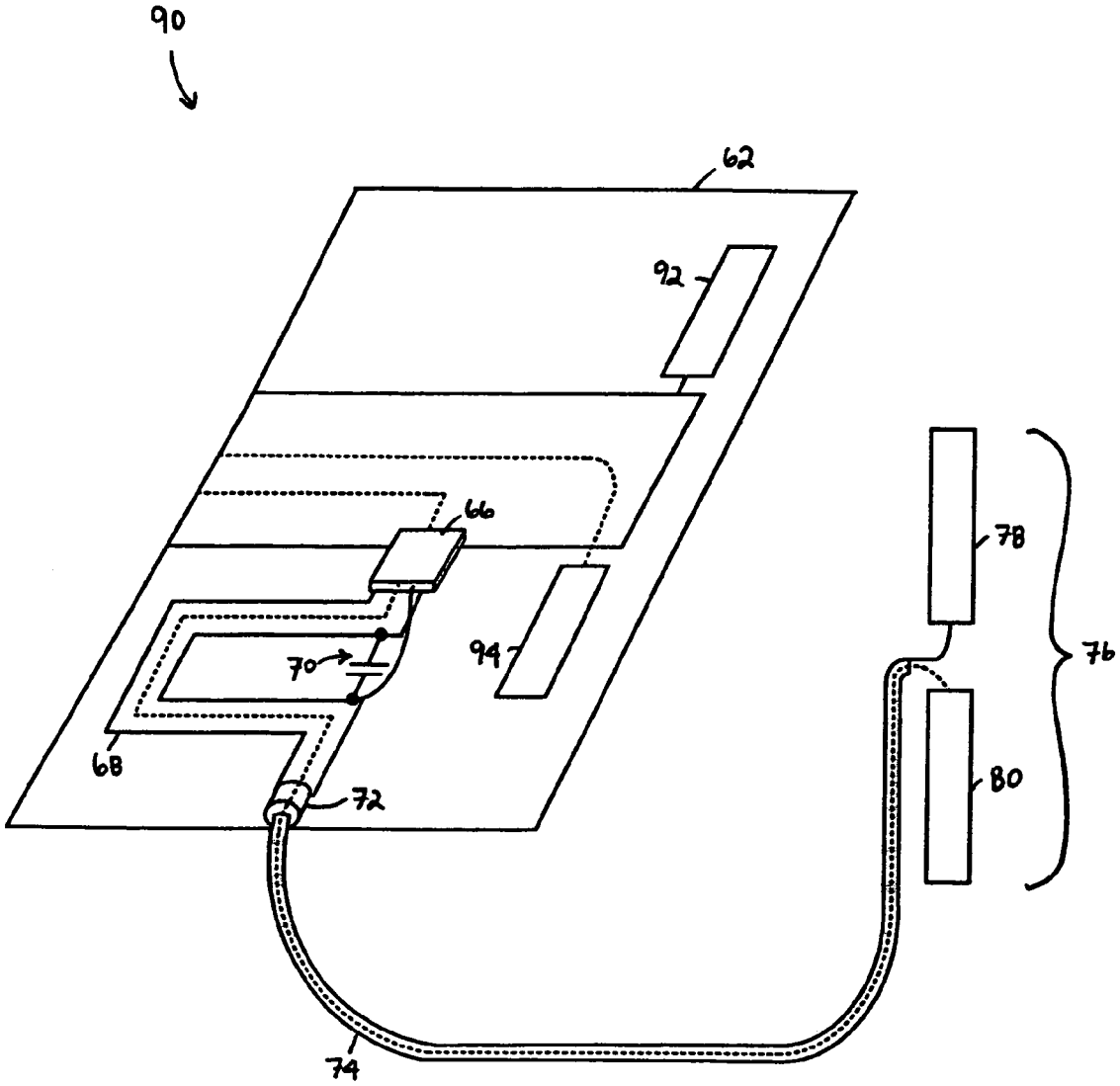
FIG. 5 shows a multi-band antenna system like that shown in FIG. 4 but also containing a diversity antenna, according to an embodiment of the present invention.

FIG. 5 shows a multi-band antenna system 90 according to another embodiment of the present invention. This embodiment is similar to that shown in FIG. 4 but also includes a diversity antenna comprising a first pole 92 and a second pole 94. The diversity antenna is configured to operate in conjunction with the dipole 76. According to an aspect of the invention, the dipole 76 may be configured so that it has a polarization (e.g. vertical) that is orthogonal to a polarization (e.g. horizontal) of the diversity antenna on the first PCB 62.

Figure 6:
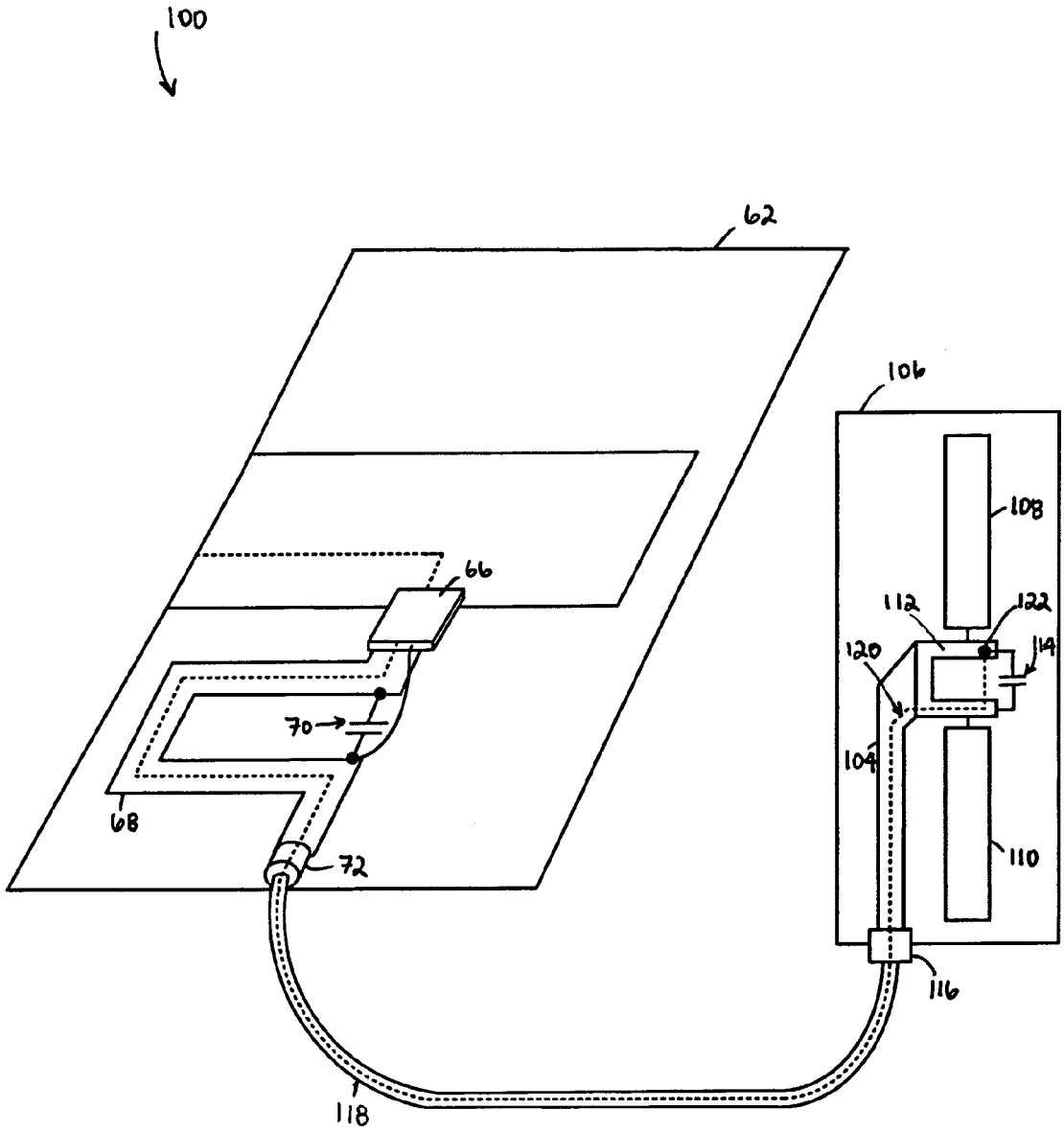
FIG. 6 shows a multi-band antenna system like that shown in FIG. 4 but also including a matching circuit for the dipole antenna portion of the antenna system, according to an embodiment of the present invention.

Referring to FIG. 6, there is shown a multi-band antenna system 100 according to another embodiment of the present invention. The multi-band antenna system 100 is similar to the multi-band antenna system 60 shown in FIG. 4, except that the dipole 76 and a microstrip (or stripline) extension 104, substituting for a portion of the coaxial cable 74, are formed on a second printed circuit board (PCB) 106. The dipole comprises first and second poles 108 and 110, between which is disposed a matching circuit. A second loop section 112 formed from the ground conductor at one end of the microstrip extension 104 provides an inductive element, which is coupled in parallel with a second shunt capacitor 114 to form the matching circuit (i.e. a shunt tuning network). A connector 116 on the second PCB 106 is configured to receive one end of a coaxial cable 118, the center conductor of which is coupled to the signal conductor 120 of the microstrip extension 104. The signal conductor of the microstrip extension 104 extends across the PCB 106 and terminates at a contact point 122 on the end of the second loop section 112 that is coupled to the first pole 108 of dipole as shown or in an equivalent manner. The position of the contact point 122 is selected so that the matching circuit can operate as a balun for the dipole, in addition to providing a matching function for the dipole.

The matching circuit is tuned so that the antenna impedance matches the impedance (e.g. 50 ohms) of the rest of the antenna system 100 for signals received in the second frequency band of interest described above. If, for example, the second frequency band corresponds to the PCS 1.92 GHz band and the dipole is a short dipole having a nominal length of a quarter wavelength as described in the exemplary embodiment above, the second loop section 112 may be formed and dimensioned so that it has an inductance of about 1 nH, and the capacitance of the second shunt capacitor 114 may be selected so that it has a capacitance of about 1 pF. Accordingly, the matching circuit provides a substantially balanced tuning network (i.e. provides a balanced feed to the dipole antenna) for signals having frequencies within the second frequency band. For signals having frequencies within the first frequency band of interest, the reactive circuit on the first PCB 62 operates as a trap, as described above, and the combined lengths of the first pole 108 of the dipole, the ground conductor of the microstrip extension 104, and the outer conductor of the coaxial cable 118, form a monopole antenna (i.e. whip antenna). The monopole antenna operates in substantially the same manner as described above. The combined lengths of the first pole 108 of the dipole, the microstrip extension 104, and the coaxial cable 118 are made to optimize the whip antenna's receptivity. If, for example, the first frequency band corresponds to the CDMA 0.86 GHz band and the dipole is a dipole of nominal length of a quarter wavelength having pole lengths of approximately 20 mm each, the microstrip extension 104 and coaxial cable 118 can be made so that their summed lengths are 60 mm (e.g. 10 mm and 50 mm, respectively, in an exemplary embodiment).

Figure 7:
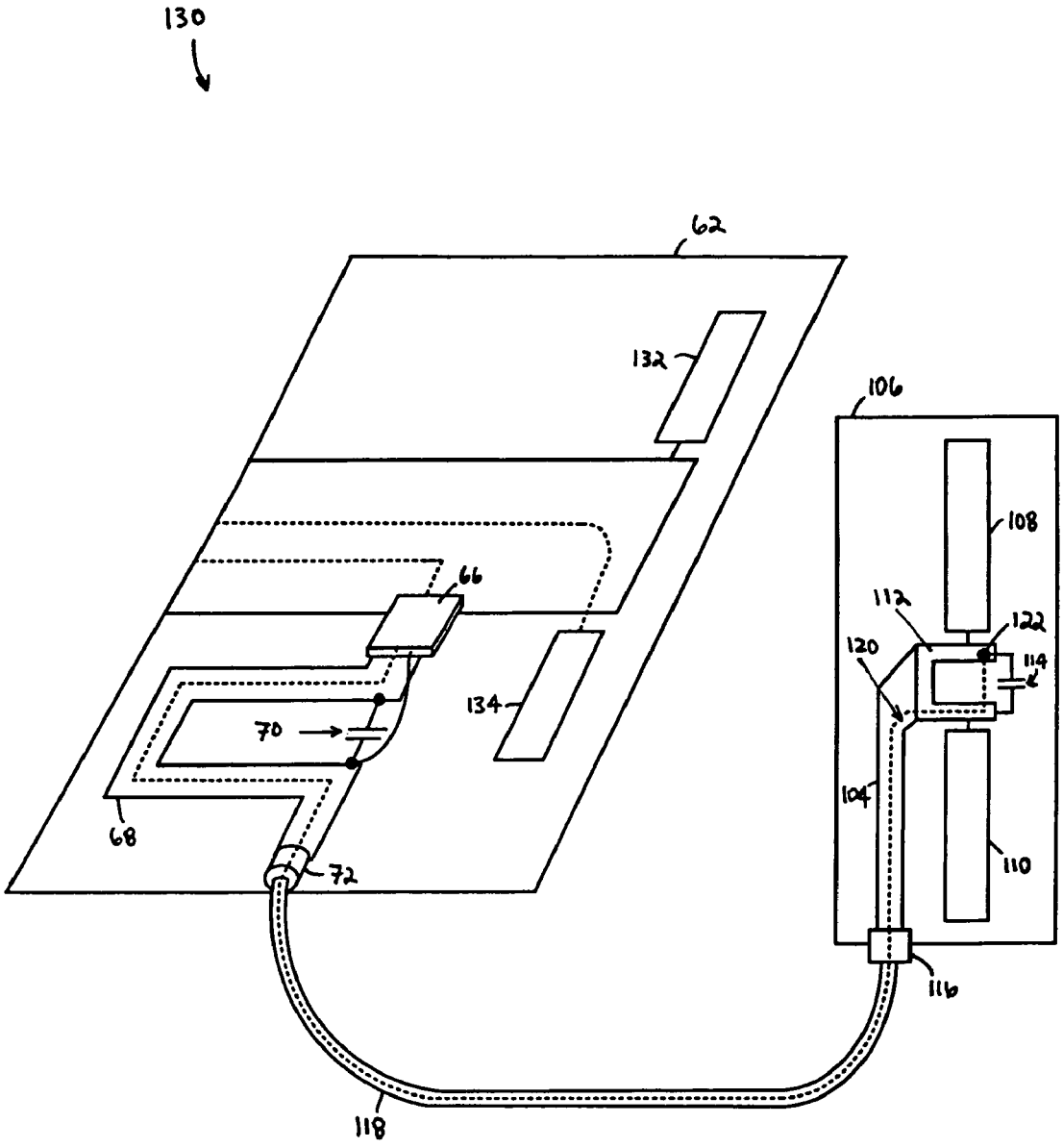
FIG. 7 shows a multi-band antenna system like that shown in FIG. 6 but also containing a diversity antenna, according to an embodiment of the present invention.

FIG. 7 shows a multi-band antenna system 130 according to another embodiment of the present invention. This embodiment is similar to that shown in FIG. 6 but also includes a diversity antenna comprising a first pole 132 and a second pole 134. The diversity antenna is configured to operate in conjunction with the dipole on the second PCB 106. According to an aspect of the invention, the dipole on the second PCB 106 may be configured so that it has a polarization (e.g. vertical) that is orthogonal to a polarization (e.g. horizontal) of the diversity antenna. Although not shown, the diversity antenna may also have an accompanying matching circuit, e.g. similar to the matching circuit employed for the dipole on the second PCB 106.

While particular embodiments of the present invention have been shown and described, it will be obvious to those skilled in the art that, based upon the teachings herein, changes and modifications may be made without departing from this invention and its broader aspects. For example, whereas an antenna for a PC Card has been shown in the exemplary embodiments, the inventor has conceived that the fundamental multi-band antenna idea may apply to other electronic communications devices (e.g. peripherals (i.e. other "card-like devices", smart phones, etc.). Therefore, the appended claims are intended to encompass within their scope all such changes and modifications as are within the true spirit and scope of this invention.

What is claimed is:

1. A multi-band antenna system, comprising:

a reactive circuit having a loop section and a shunt capacitor, the loop section having a ground conductor, forming a shunt inductor of the reactive circuit, and a signal conductor, the shunt capacitor having a first terminal coupled to the ground conductor at the first end of the loop section and a second terminal coupled to the ground conductor at the second end of the loop section;

a dipole antenna having a first pole and a second pole; and a transmission means coupling the first pole to the ground conductor and coupling the second pole to the signal conductor.

2. The multi-band antenna system of claim 1 wherein the capacitance of the shunt capacitor and the inductance of the shunt inductor are determined so that the reactive circuit operates as a trap for received signals having frequencies within a first frequency band.

3. The multi-band antenna system of claim 2 wherein the length of the first pole and the length of the transmission means are determined based upon the first frequency band so that a monopole antenna formed from the first pole and the transmission means is capable of receiving signals within the first frequency band.

4. The multi-band antenna system of claim 3 wherein a radiation impedance of the monopole antenna is input directly into a feed system and transmitted from the feed system to a radio signal receiver.

5. The multi-band antenna system of claim 4 wherein the feed system is a diplexer.

6. The multi-band antenna system of claim 5 wherein the radio signal receiver is a radio signal receiver of a wireless modem.

7. The multi-band antenna system of claim 1 wherein the loop section is formed from a portion of the transmission means.

8. The multi-band antenna system of claim 7 wherein the length of the second pole is determined based upon a second frequency band so that the dipole antenna is capable of receiving signals within the second frequency band.

9. The multi-band antenna system of claim 1, further comprising a diversity dipole antenna.

10. The multi-band antenna system of claim 9 wherein a polarization of the diversity dipole antenna is orthogonal to a polarization of the dipole antenna.

11. The multi-band antenna system of claim 1, further comprising a matching circuit coupled between first and second poles of the dipole antenna.

12. The multi-band antenna system of claim 11 wherein said matching circuit is further configured to operate as a balun for the dipole antenna.

13. The multi-band antenna system of claim 11 wherein the matching circuit, the dipole antenna and a portion of the transmission means are formed on a first printed circuit board and the reactive circuit is formed on a second printed circuit board.

* * * * *